US006805842B1

(12) United States Patent
Bodner et al.

(10) Patent No.: US 6,805,842 B1
(45) Date of Patent: Oct. 19, 2004

(54) REPUNCTURABLE SELF-SEALING SAMPLE CONTAINER WITH INTERNAL COLLAPSIBLE BAG

(75) Inventors: Kevin S. Bodner, Belmont, CA (US); Tyler A. Palmer, San Francisco, CA (US); Pejman Ghanouni, Menlo Park, CA (US)

(73) Assignee: MDS Sciex, South San Francisco, CA (US)

( * ) Notice: Subject to any disclaimer, the term of this patent is extended or adjusted under 35 U.S.C. 154(b) by 531 days.

(21) Appl. No.: 09/976,628

(22) Filed: Oct. 12, 2001

(51) Int. Cl.[7] ..... B01L 3/00

(52) U.S. Cl. ..... 422/102; 422/99; 422/104; 215/247; 215/269; 220/495.01; 220/495.05; 220/500; 220/528

(58) Field of Search ..... 422/99, 102, 104; 215/11.1, 11.3, 11.6, 247, 248, 249, 269; 228/9.1, 9.2, 9.4, 495.01, 495.05, 495.06, 500, 528

(56) References Cited

U.S. PATENT DOCUMENTS

| | | | | | |
|---|---|---|---|---|---|
| 2,460,641 | A | | 2/1949 | Kleiner | 128/214 |
| 3,955,698 | A | | 5/1976 | Hammer | 215/11 E |
| 4,457,455 | A | * | 7/1984 | Meshberg | 222/105 |
| 4,880,125 | A | * | 11/1989 | LeBeau | 215/11.3 |
| 4,913,702 | A | | 4/1990 | Yum et al. | |
| 5,301,825 | A | * | 4/1994 | Di Scala et al. | 215/11.1 |
| 5,356,016 | A | | 10/1994 | Wiedemann | 215/11.3 |
| 5,377,877 | A | * | 1/1995 | Brown et al. | 222/105 |
| 5,524,783 | A | * | 6/1996 | Popoff | 215/386 |
| 5,553,748 | A | * | 9/1996 | Battle | 222/94 |
| 5,579,935 | A | * | 12/1996 | Atkin et al. | 215/11.1 |
| 5,621,445 | A | * | 4/1997 | Fong et al. | 347/87 |
| 5,718,334 | A | | 2/1998 | Demel | 206/439 |
| 5,836,922 | A | * | 11/1998 | Hansen et al. | 604/214 |
| 5,839,623 | A | | 11/1998 | Losenno et al. | |
| 5,860,363 | A | * | 1/1999 | Childers et al. | 101/483 |
| 5,873,491 | A | | 2/1999 | Garcia et al. | 222/95 |
| 5,875,936 | A | | 3/1999 | Turbett et al. | |
| 5,919,360 | A | | 7/1999 | Contaxis, III et al. | |
| 6,042,850 | A | | 3/2000 | Ida et al. | 426/2 |
| 6,116,723 | A | * | 9/2000 | Childers | 347/85 |
| 6,149,871 | A | | 11/2000 | Guirguis et al. | |
| 6,253,936 | B1 | * | 7/2001 | Kong | 215/11.3 |

* cited by examiner

*Primary Examiner*—Jill Warden
*Assistant Examiner*—Dwayne K Handy
(74) *Attorney, Agent, or Firm*—Kelvan Patrick Howard; Richard L. Neeley

(57) ABSTRACT

A sample container for minimizing evaporation of a contained volume of sample includes a container housing, a repuncturable self-sealing membrane, and a collapsible sample bag. The container housing includes an open end and a hollow interior region. The repuncturable self-sealing membrane configured to self-seal after repeated punctures is engaged in the open end of the container housing and includes an exterior surface exposed to the external environment and an interior surface oriented toward the hollow interior region of the container housing. The collapsible sample bag includes a proximate end that is permanently attached to the interior surface of the repuncturable self-sealing membrane.

30 Claims, 3 Drawing Sheets

REPUNCTURABLE SELF-SEALING SAMPLE CONTAINER WITH INTERNAL COLLAPSIBLE BAG

BACKGROUND OF THE INVENTION

The present invention relates to sample containers and more particularly to a repuncturable self-sealing sample container employing an internal collapsible sample bag adapted to retain a dispense sample with minimum evaporation.

Those involved in the art of sample preparation and handling appreciate that solute concentration levels of small amounts of sample can be easily affected by evaporative effects, especially when the sample volume is small, for instance, on the order of microliters. Such small sample volumes undergo appreciable changes in concentration even when dispense into conventional sealed test tubes, as the non-evacuated air in these tubes is sufficient to cause evaporation, and accordingly changes in sample concentration. Sample preparation and handling at these minute volumes would benefit from a container in which evaporation is eliminated or greatly minimized.

A number of different containers have been developed for storing and dispensing fluids from an air-free environment. One particular application has been nursery bottles in which a collapsible bag, typically located within a rigid container, is filled with milk, formula, or other liquid. When topped with the appropriate nipple assembly, feeding from the nipple gradually collapses the bag, thereby minimizing the intake of air. When feeding discontinues, air can enter into the collapsible bag via nipple hole. To prevent the infant's intake of this air, the nursery bottle may require some compression in order to dispel the air before feeding resumes, or in other embodiments, the nursery bottle itself has a means to collapse the bag in order to prevent the entry of air (see, e.g., U.S. Pat. No. 3,955,698).

Another area (albeit unrelated to the first) in which airtight containers have been developed is in sterile intravenous bags and blood collection structures. U.S. Pat. No. 2,460,641 describes a well-known blood collection apparatus consisting of a sealed, evacuated test tube having a needle pierceable, self-sealing top. Blood is dispensed into the test tube via a holder having two oppositely oriented cannulae. One cannula pierces the membrane of the test tube and the other cannula is connected to an intravenous line. The negative pressure of the test tube operates to extract the blood or other fluid from the intravenous line into the test tube.

When comparing the aforementioned needs to these conventional containers, several disadvantages become obvious. As to the nursery bottle, even the low amounts of air entering to the container would cause an unacceptable amount of evaporation in the present application where milliliters or microliters of sample are being handled. As to the blood container, the evacuated environment would prevent accurate volume regulation of sample dispensed into or extracted from the container. Both containers include appreciable head volumes which could not be effectively evacuated.

What is needed is an improved sample container for retaining small volumes in an extremely low evaporative environment.

SUMMARY OF THE INVENTION

The present invention provides for a sample container configured to retain microliters of sample volumes in an extremely low evaporative environment. In one embodiment, the sample container includes a container housing, a repuncturable self-sealing membrane, and a collapsible sample bag. The container housing includes an open end and a hollow interior region. The repuncturable self-sealing membrane configured to self-seal after repeated punctures is engaged in the open end of the container housing and includes an exterior surface exposed to the external environment and an interior surface oriented toward the hollow interior region of the container housing. The collapsible sample bag includes a proximate end that is permanently attached to the interior surface of the repuncturable self-sealing membrane.

Other aspects of the invention will be apparent in view of the following drawings and description of specific embodiments of the invention.

BRIEF DESCRIPTION OF THE DRAWINGS

For convenience and clarity, like numerals identify like parts throughout the drawings.

DESCRIPTION OF THE SPECIFIC EMBODIMENTS

The sample container of the present invention can be used in a variety of different areas. In one application, the sample container is used as a substantially airtight, conventionally-sized test tube or similar structure in which evaporation of the contained sample is minimized. In another application, a micro-miniature version of the sample container is employed in an array such as 96, 384 or 1536 well tray. In still another application, the sample container is used for the aforementioned purpose of providing a minimal evaporative environment but is in addition constructed from materials which are "substantially transparent" to an impinging electromagnetic test signal, allowing the signal to electromagnetically couple to the contained sample, the test signal becoming modulated by the contained sample. The modulated test signal can then be recovered, the modulation being used to identify the contained sample, or molecular or cellular events within the contained sample. This and other techniques for identifying molecular and cellular events are described further in applicant's co-pending patent applications listed below. The term "substantially transparent" material, as used herein, refers to a material having a maximum dielectric loss factor of $1\times10^{-3}$ at a test signal frequency. Exemplary "substantially transparent" materials include polypropylene, polytetrafluoroethylene, or such other similar materials. Exemplary test signal frequencies would be one or more a–c signals operating in the Hz, KHz, MHz, or the GHz frequency regions, and in a particular embodiment, signals operate at one or more frequencies from 1 KHz to 1000 GHz.

Figure 1:
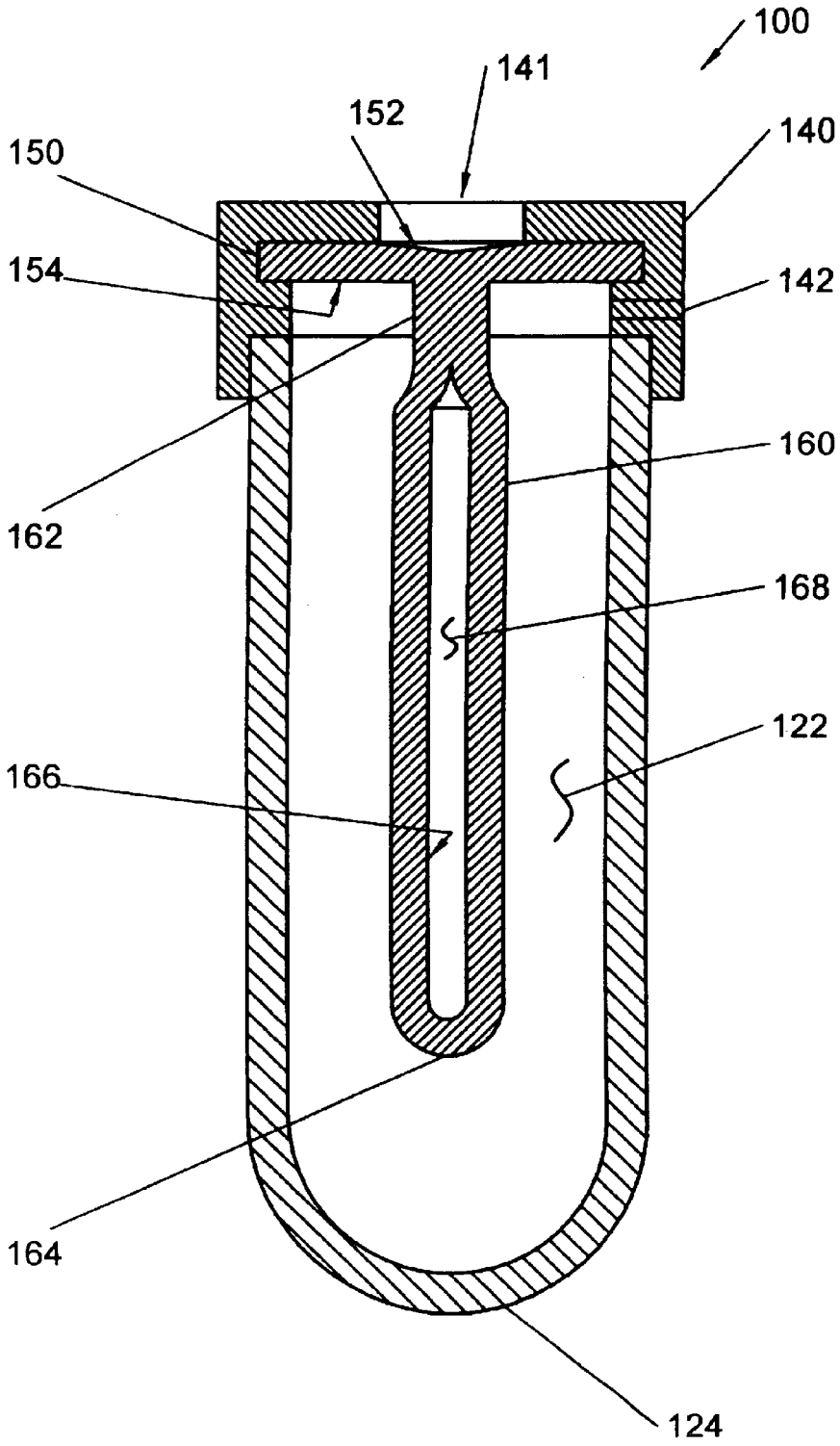
FIG. 1 illustrates a cross-sectional view of a sample container in an empty state in accordance with one embodiment of the present invention.

FIG. 1 illustrates a cross-sectional view of a sample container 100 in accordance with one embodiment of the present invention. The sample container 100 includes a container housing 120, a container plug 140 attached to the open end of the container housing 120, a repuncturable self-sealing membrane 150, and a collapsible sample bag 160. As used herein, the term "repuncturable self-sealing membrane" refers to a membrane which can be punctured multiple times and self-seals, both when an inserted needle is present in the membrane and after its removal therefrom. Exemplary embodiments of the repuncturable self-sealing membrane include membranes constructed from silicon, latex, polyurethane, other elastomeric materials, and the like. The term "collapsible sample bag" as used herein refers to a bag or other container that is substantially reducible to the volume of liquid contained within it and is substantially devoid or air or of the external atmosphere.

The container housing 120 includes an interior region 122 into which the collapsible bag 160 extends. In one embodiment, the container housing 120 is fabricated from a rigid material such as a polycarbonate material, or other materials such as polyetheretherketone (PEEK®), chlorotrifluoroethylene (KEL-F®), or borosilicate glass. In another embodiment, a highly thermally conductive material may be used when, for instance, a temperature compensation or control element is attached to the outer surface 124. In a further embodiment, the container housing 120 is constructed from a material that is "substantially transparent" (as defined above) to electromagnetic test signals impinging upon it.

The container housing 120 is cylindrical in shape in one embodiment, generally resembling in one embodiment a conventional test tube in form. In this embodiment, the sample container 100 may be shaped and sized to contain milliliters of sample. However, the sample container may assume other shapes and sizes in alternative embodiments of the invention. Further, the container housing 120 may contain within the hollow interior region 122 a means for controlling or stabilizing the temperature within the container housing 120. Such means may include a heating and/or a cooling element, or a thermally insulating material such as air or liquid surrounding the collapsible bag. In such an embodiment, the container housing 120 may be constructed from a thermally insulating material to insulate the hollow interior region from the external environment. In another embodiment, the temperature control means (such as an air chamber, liquid bath or liquid-filled jacket, or heating and/or cooling element such as a Peltier thermal electric cooling device), may contact the external surface of the container housing 120. In this embodiment, the container housing will be constructed from a thermally conductive material. For example, in the multi-well embodiment described below, the convex clydrical or conical protrusions that form the external housing surface 124 can mate with/be inserted into their respective matching concave cylindrical or conical cavities of a thermal cycling block such as those found on thermal cycling instruments used for PCR.

The container housing 120 itself may take on a variety of shapes and sizes. In one embodiment, the container housing 120 is sized to fit into a 96 well tray having a radius ranging from 0.2 mm to 7 mm and a depth from 2 mm to 200 mm. In a specific embodiment, the container housing 120 measures 4 mm (radius) by 4 mm (depth), having an approximate volume of 50 microliters. In other embodiments, the container housing 120 is sized and shaped to form individual wells in a 384 or 1536 well tray. Other shapes and sizes are similarly possible in alternative embodiments under the present invention.

The container plug 140 is attached (permanently or removably) to the open end of the container housing 120. In one embodiment of the invention, the container plug 140 includes one or more air valves 142 to permit the intake and/or outflow of air into the container housing to further facilitate sample dispense into, or asperate from the sample container 100. In its preferred embodiment, the top surface of the container plug 140 further includes an access port 141 that exposes the repuncturable self-sealing membrane 150. In one embodiment the container plug is sized to top the aforementioned container housings in the 96 well tray having a radius ranging from 2.5 mm to 7.5 mm and a depth of approximately 2 mm. In a specific embodiment, the container plug 140 measures 5 mm (radius) by 2 mm (depth) and is constructed from polytetrafluoroethylene, polycarbonate, polyetheretherketonr (PEEK®) ethylene tetrfluoroethylene (ETFE®), ethylene and tetrafluoroethylene (TEFZEL®), chlorotrifluoroethylene (KEL-F®) or other such similar materials. The reader will appreciate that container plugs and membranes of other dimensions and material compositions may be used in alternative embodiments under the present invention.

The membrane 150 operates to permit repeated puncturing by a needle, pipette tip, capillary tube, or similar structures that operate to aspirate sample out of, or dispense sample into the collapsible bag 160 (described below). The membrane 150 has an exterior surface 152 which is exposed to the external environment and an interior surface 154 which is oriented toward the hollow interior region 122 of the container housing 120. In a specific embodiment, the membrane 150 is attached (permanently or removably) to the container plug and is formed from silicon, although other materials such as latex, polyurethane, or other elastomeric materials may be used in alternative embodiments. The membrane 150 itself may include air vents (not shown) to permit the passage of air into and out of the hollow interior region 122. Preferably, the membrane 150 includes a centering indentation 156, notch, or other visual indicia in order to facilitate needle alignment to the collapsible sample bag 160. Alternatively, or in addition, the membrane 150 may include an rigid guide (e.g., a funnel shaped structure) embedded within the membrane 150 operable to guide the needle properly into the collapsible sample bag. In another embodiment, the collapsible sample bag 160 is preloaded with air or fluid (prior to initial sealing) in order to expand the bag slightly, thereby providing a larger target area for needle insertion. Once the needle is inserted, the preloaded air or fluid can be evacuated and the desired sample dispensed into the collapsible sample bag 160.

The collapsible bag 160 includes a proximate end 162 that is permanently attached to the interior surface 154 of the membrane 150 and a distal end 164 that remains unattached, the collapsible sample bag having an interior bag surface 166 that defines an enclosed sample chamber 168. The collapsible sample bag 160 includes a non-collapsible head volume area near the proximate end. This area is made small (ranging from 0.5%–5% of the total expanded volume in one embodiment) so as to minimize the volume of non-evacuable air within the bag 160. In general, the collapsible sample bag will have a collapsed volume as small as 0.01 $\mu$l and an expanded volume as large as 10,000 $\mu$l. The present invention is not limited to these volumes and collapsible sample bags of smaller and larger volumes may be used in alternative embodiments of the present invention.

The collapsible sample bag 160 may be constructed from a variety of materials including polypropylene or elastomers such as silicon, latex, polyurethane, and the like. Further, the collapsible sample bag may be coated with a material such as silane in order to make the interior bag surface more inert. In another embodiment, the collapsible sample bag 160 may consist of a material which is "substantially transparent" (as defined above) to an impinging electromagnetic test signal. The aforementioned material of polypropylene or such similar material would be suitable for use for electromagnetic test signals in the Hz, KHz, MHz, and GHz frequency ranges.

In some embodiments, the membrane 150 and the collapsible sample bag 160 may be composed of dissimilar materials. For example, the proximate end 162 may be permanently attached to the membrane's interior surface 154 through a co-molding process or using an adhesion process in which the two structures are permanently attached. In another embodiment, the proximate end 162 of the collapsible sample bag and the membrane 150 are composed of the same materials, e.g., silicon, latex, or polyurethane. In this embodiment, the proximate end 162 is permanently attached to the membrane's interior surface 154 using standard molding processes.

Figure 2:
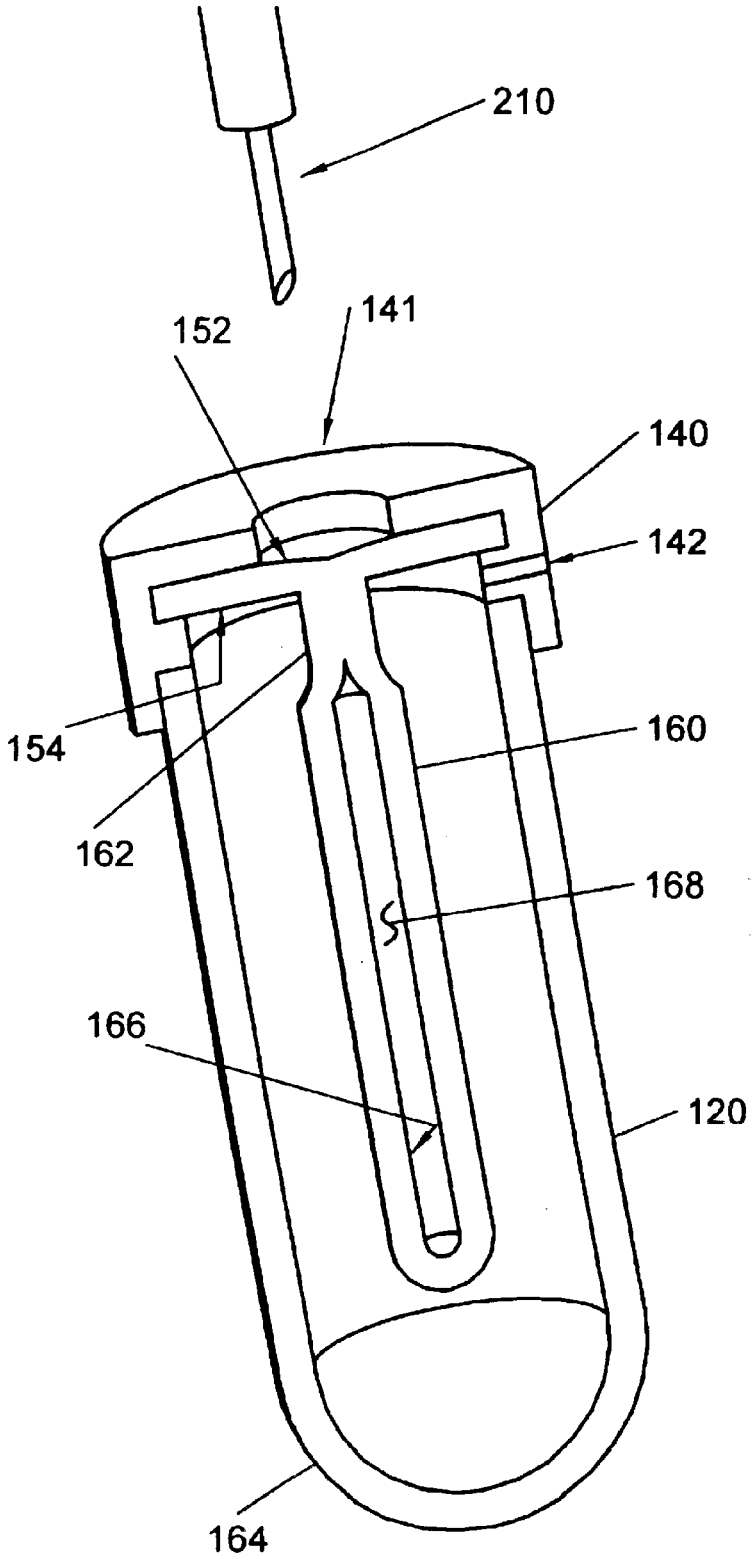
FIG. 2 illustrates a cross-sectional view of a sample container in a full state in accordance with one embodiment of the present invention.

FIG. 2 illustrates a cross-sectional view of the sample container 100 in its full state in accordance with one embodiment of the present invention. A needle 210 is inserted into the access port 141 and pierces the membrane 150. As used in the present application, the scope of the term "needle" includes conventional syringe needles as well as pipette needles, capillary tubes and similar structures, such as those described in applicant's co-pending application Ser. No. 09/880,331 entitled "Reentrant Cavity Bioassay for Detecting Molecular or Cellular Events," and Ser. No. 09/880,746 entitled "Pipette-Loaded Bioassay Assembly for Detecting Molecular or Cellular Events." The pipette tip, capillary tube, or similar structure may be adapted to pierce the repuncturable membrane, for instance, by attaching a rigid piercing tip at the pipette or capillary structure.

The needle is advanced through the proximate end 162 of the collapsible bag 160 and into the sample chamber 168 where the sample is dispense. While the proximate end 162 of collapsible bag remains secure, the detached enclosed end 164 and the sides of the collapsible bag 160 expand to conform to the size and shape of the container's interior region 122. The self-sealing property of the membrane 150 ensures that air does not enter the collapsible bag 160, thereby minimizing evaporation. During sample extraction, the process operates in mechanically much the same manner. The needle 210 is aligned on the top of the membrane 150, subsequently advanced into the interior chamber 168 of the collapsible sample bag 160, and brought into contact with the contained sample. The plunger (not shown in FIG. 2) is withdrawn to extract the sample from the container 100 and into the syringe barrel (not shown). The membrane 150 self-seals around the needle 210, preventing air from entering the sample container 100 during the extraction process.

In a specific application, the sample container 100 is used as a holding vessel for a calibration solution having a previously measured complex permittivity value. The contained solution can then be used to calibrate measurement instruments, such as network analyzers, as the permittivity of the calibration solution is previously known. The calibration solution can also be used to more accurately determine the complex permittivity of test solution as described in applicant's co-pending patent application entitled "System and Method for Creating a Solution with Desired Dielectric Properties Useful for Determining the Complex Permittivity of a Test Solution," filed Oct. 5, 2001, herein incorporated by reference. The construction of the sample container minimizes evaporation, thereby maintaining the calibration solution's concentration, preserving its previously measure complex permittivity value. Exemplary calibration solutions include de-ionized water, well known buffers such as TWEEN, PBS, as well as calibration solutions described in applicant's aforementioned pending application. Of course, the sample container described herein can hold solutions of other compositions for the aforementioned application or other applications in which a low evaporative environment is desired.

Figure 3:
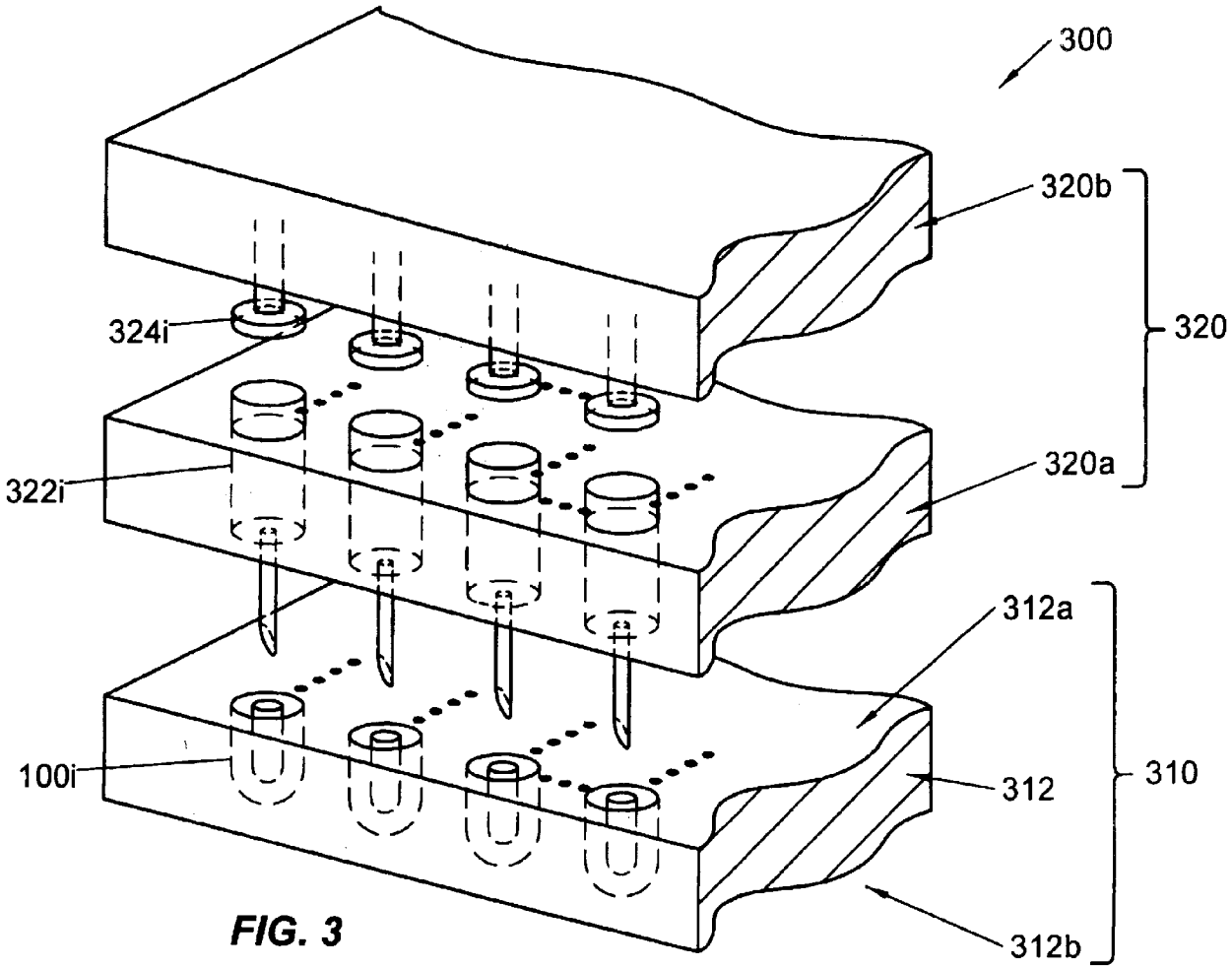
FIG. 3 illustrates an exploded view of a syringe and sample container array in accordance with one embodiment of the present invention.

FIG. 3 illustrates an exploded view of a syringe and sample container array 300 in accordance with one embodiment of the present invention. The array 300 includes a sample container array 310 and a syringe array 320. The sample container array 310 is formed on a plate 312 having a first major surface 312*a* and a second major surface 312*b*. The first major surface (top plate in the illustrated embodiment) 312*a* plate includes a plurality of sample containers $\mathbf{100}_i$, each of which consists of a micro-miniature version of the sample container 100 described above in one embodiment of the present invention. In a specific embodiment, the plate 312 is a test tube holder for conventional test tubes. In another embodiment, the plate 312 is a 96, 384, or 1536 well tray having a respective number of micro-miniature sample containers $\mathbf{100}_i$ formed therein, the center-to-center spacing of the micro-miniature sample containers $\mathbf{100}_i$ conforming to conventional center-to-center spacing of 96, 384, or 1536 well trays. Alternatively, or in addition, one or more of the sample container's housings and collapsible sample bags may be formed from a "substantially transparent" material (as defined above), such as polypropylene or polytetrafluoroethylene.

The syringe array 320 includes a syringe plate 320*a* and a plunger plate 320*b*. The syringe plate 320*a* includes a plurality of syringe assemblies $\mathbf{322}_i$ including the syringe barrel and needle, but not the plunger. In the preferred embodiment, the number of syringe assemblies $\mathbf{322}_i$ equals the number of sample containers $\mathbf{100}_i$, although this is not necessary, and in an alternative embodiment there may be more syringe assemblies $\mathbf{322}_i$ than sample containers $\mathbf{100}_i$, or vice versa.

The syringe array 320 further includes a plunger plate 320*b* in which is formed a plurality of plungers $\mathbf{324}_i$. Each of the plungers $\mathbf{324}_i$ may be connected to an actuator or other motor driven structure (not shown) which, when activated, advances (or withdraws) the plunger $\mathbf{324}_i$ into (or from) the syringe barrel in order to dispense (or aspirate) a volume of contained sample into (or from) the sample container $\mathbf{100}_i$. Each actuator may be independently controlled to permit dispensing or aspiration of sample into or from one or a sub-group of the total number of the sample containers $\mathbf{100}_i$. The sample container plate 312 may consist of a 96, 384, or 1536 tray well having micro-miniature sample containers $\mathbf{100}_i$. The syringe plate 320*a* and plunger plate 320*b* may consist of the same or similar materials as conventional well trays such as polycarbonate, polystyrene, or polypropylene and the like.

In one embodiment of the invention, the sample container array 310 is located on a horizontally moving platform such as a turntable (not shown), and the syringe array 320 is located on an robotic or manually controlled arm which has a vertical axis of movement, but remains horizontally stationary. In the preferred embodiment, the center of each of the sample containers $\mathbf{100}_i$ is aligned with the needles extending from the syringe assembly $\mathbf{322}_i$.

During a sample aspiration, movement, and dispensing process, the plunger $\mathbf{324}_i$ that is positioned above the sample container $\mathbf{100}_i$ from which the sample is to be extracted is extended into the syringe barrel of the syringe assemble $322_i$. As explained above, this process may be performed using an actuator or other motor driven means to advance the plunger $324_i$.

Once the plunger is advanced a sufficient amount to extract the desired volume, the syringe array 320 is lowered so that the needle (syringe needle, pipette tip, capillary, or similar structure as described above) pierces the membrane of the sample container $100_i$, the needle extending into the interior chamber of the collapsible sample bag. Alignment of the needle and membrane can be computer controlled, as well as all of the aforementioned process described herein. The plunger $324_i$ is subsequently withdrawn to extract the desired sample volume (possibly through the use of a computer-controlled actuator), after which the syringe assembly 320 is raised. The turntable is laterally rotated to position the receiving sample container under the loaded syringe assembly. The syringe assembly 320 is lowered, piercing the membrane of the receiving sample container $100_i$. The plunger $324_i$ is advanced to dispense the extracted sample into the collapsible sample bag of the receiving sample container, after which the syringe assembly 320 is raised. Some or all of the aforementioned processes may be repeated manually, or automatically in response to a computer that is pre-programmed with code that translates the aforementioned steps in computer-readable instructions. Further, the sample container array 310 may be held stationary and the manual or robotic arm have both vertical and horizontal axis of movement. The reader will appreciate that a host of hardware and software modifications not specifically mentioned are possible under alternative embodiments of the present invention.

While the above is a complete description of possible embodiments of the invention, various alternatives, modifications and equivalents may be used to which the invention is equally applicable. Therefore, the above description should be viewed as only a few possible embodiments of the present invention, the boundaries of which is appropriately defined by the metes and bounds of the following claims.

The following commonly owned, co-pending applications are herein incorporated by reference in their entirety for all purposes:

Ser. No. 09/243,194 entitled "Method and Apparatus for Detecting Molecular Binding Events, filed Feb. 1, 1999;

Ser. No. 09/365,578 entitled "Method and Apparatus for Detecting Molecular Binding Events," filed Aug. 2, 1999;

Ser. No. 09/243,196 entitled "Computer Program and Database Structure for Detecting Molecular Binding Events," filed Feb. 1, 1999;

Ser. No. 09/480,846 entitled "Resonant Bio-assay Device and Test System for Detecting Molecular Binding Events," filed Jan. 10, 2000;

Ser. No. 09/365,978 entitled "Test Systems and Sensors for Detecting Molecular Binding Events," filed Aug. 2, 1999;

U.S. Pat. No. 6,287,776 entitled "Method For Detecting and Classifying Nucleic Acid Hybridization";

U.S. Pat. No. 6,287,874 entitled "Methods for Analyzing Protein Binding Events";

Ser. No. 09/687,456 entitled "System and method for detecting and identifying molecular events in a test sample," filed Oct. 13, 2000;

Ser. No. 60/248,298 entitled "System and method for real-time detection of molecular interactions," filed Nov. 13, 2000;

Ser. No. 09/775,718 entitled "Bioassay device for detecting molecular events," filed Feb. 1, 2001;

Ser. No. 09/775,710 entitled "System and method for detecting and identifying molecular events in a test sample using a resonant test structure," filed Feb. 1, 2001;

Ser. No. 60/268,401 entitled "A system and method for characterizing the permittivity of molecular events," filed Feb. 12, 2001;

Ser. No. 60/275,022 entitled "Method for detecting molecular binding events using permittivity," filed Mar. 12, 2001;

Ser. No. 60/277,810 entitled "Bioassay device for Detecting Molecular Events," filed Mar. 21, 2001;

Ser. No. 09/837,898 entitled "Method and Apparatus for Detection of Molecular Events Using Temperature Control of Detection Environment," filed Apr. 18, 2001

Ser. No. 09/880,331 entitled "Reentrant Cavity Bioassay for Detecting Molecular or Cellular Events," filed Jun. 12, 2001;

Ser. No. 09/880,746 entitled "Pipette-Loaded Bioassay Assembly for Detecting Molecular or Cellular Events," filed Jun. 12, 2001

Ser. No. 09/880,746 entitled "Pipette-Loaded Bioassay Assembly for Detecting Molecular or Cellular Events," filed Jun. 12, 2001;

Ser. No. 09/880,746 entitled Pipette-Loaded Bioassay Assembly for Detecting Molecular or Cellular Events," filed Jun. 12, 2001;

Ser. No. 09/880,746 entitled "Pipette-Loaded Bioassay Assembly for Detecting Molecular or Cellular Events," filed Jun. 12, 2001; and Applicant's pending application entitled "System and Method for Creating a Solution with Desired Dielectric Properties Useful for Determining the Complex Permittivity of a Test Solution," filed Oct. 5, 2001

What is claimed is:

1. A sample container, comprising:

a container housing having an open end and a hollow interior region;

a repuncturable self-sealing membrane engaged in the open end of the container housing and configured to self-seal after repeated punctures, the repuncturable self-sealing membrane comprising an exterior surface exposed to the external environment, and an interior surface oriented toward the hollow interior region of the container housing; and a collapsible sample bag comprising a proximate end that is permanently attached to the interior surface of the repuncturable self-sealing membrane.

2. The sample container of claim 1, wherein the container housing and collapsible sample bag are cylindrical in shape.

3. The sample container of claim 1, wherein the collapsible sample bag and the container housing comprises a material which has a maximum dielectric loss factor of $1\times10^{-3}$ at one or more frequencies from 1 KHz to 1,000 GHz.

4. The sample container of claim 1, further comprising a container plug circumscribing the repuncturable self-sealing membrane, the container plug comprises one or more vents for admitting the external environment into the hollow interior region of the container housing.

5. The sample container of claim 1, wherein the repuncturable self-sealing membrane comprises one or more vents for admitting the external environment into the hollow interior region of the container housing.

6. The sample container of claim 1, wherein the interior hollow region of the container housing comprises a temperature controlled chamber.

7. The sample container of claim 1, wherein the repuncturable self-sealing membrane and the collapsible sample bag are composed of dissimilar materials.

8. The sample container of claim 6, further comprising a fluid occupying a least a portion of the hollow interior region of the container housing.

9. The sample container of claim 6, further comprising a heating or cooling element attached to the exterior surface of the container housing.

10. The sample container of claim 7, wherein the repuncturable self-sealing membrane is formed from silicon, latex, or polyurethane.

11. The sample container of claim 7, wherein the integral attachment between the interior surface of the repuncturable self-sealing membrane and the proximate end of the collapsible sample bag comprises a co-molded bond.

12. The sample container of claim 1, wherein the container housing is substantially the size of a conventional test tube.

13. The sample container of claim 1, wherein the radius of the container housing is substantially the radius of a well in a 96 well tray.

14. The sample container of claim 1, wherein the radius of the container housing is substantially the radius of a well in a 384 well tray.

15. The sample container of claim 1, wherein the radius of the container housing is substantially the radius of a well in a 1536 well tray.

16. The sample container of claim 1, wherein the collapsible bag has a collapsed volume of less than 10,000 microliters.

17. The sample container of claim 16, wherein the collapsible bag has a collapsed volume of substantially 0.01 microliters and an expandable volume of greater than 1 microliter.

18. An array of sample containers, comprising:

a plate having a first major surface;

a plurality of container housings formed within the first major surface of the plate, each of the plurality of container housings having an open end and a hollow interior region;

a plurality of repuncturable self-sealing membranes engaged in the open end of a respective plurality of container housings, wherein each of the plurality of repuncturable self-sealing membranes comprises an exterior surface exposed to an external environment, and an interior surface oriented toward the hollow interior region of the container housing; and a plurality of collapsible sample bags extending into a respective plurality of hollow interior regions of the container housings, each collapsible sample bag comprising a proximate end that is permanently attached to the interior surface of the repuncturable self-sealing membrane.

19. The array of claim 18, wherein the radius of the container housing is the radius of a well in a 96 well tray, and wherein the plate comprises a 96 well tray.

20. The array of claim 18, wherein the radius of the container housing is the radius of a well in a 384 well tray, and wherein the plate comprises a 384 well tray.

21. The array of claim 18, wherein the radius of the container housing is the radius of a well in a 1536 well tray, and wherein the plate comprises a 1536 well tray.

22. The array of claim 18, wherein one or more of the plurality of collapsible sample bags and a respective one or more plurality of container housings is formed from a material which has a maximum dielectric loss factor of $1\times10^{-3}$ at one or more frequencies from 1 KHz to 1000 GHz.

23. The sample container of claim 19, wherein the plate comprises a 96 well tray having a standard microtitre format compatible with an automated sample handling processor.

24. The sample container of claim 20, wherein the plate comprises a 384 well tray having a standard microtiter format compatible with an automated sample handling processor.

25. The sample container of claim 21, wherein the plate comprises a 1536 well tray having a standard microtiter format compatible with an automated sample handling processor.

26. The array of claim 18, wherein the one or one or more of the plurality of repuncturable self-sealing membranes and respective one or more collapsible sample bags are formed from dissimilar materials.

27. The sample container of claim 26, wherein the repuncturable self-sealing membrane is formed from silicon, latex, or polyurethane.

28. The sample container of claim 18, wherein the interior hollow region of one or more of the plurality of containers housing comprises a temperature controlled chamber.

29. The sample container of claim 28, further comprising a fluid occupying a least a portion of the hollow interior region of the one or more container housings.

30. The sample container of claim 28, further comprising a heating or cooling element attached to the exterior surface of the one or more container housings.

* * * * *